US010000927B1

(12) United States Patent
Newsome et al.

(10) Patent No.: US 10,000,927 B1
(45) **Date of Patent: *Jun. 19, 2018**

(54) MODULAR CONSTRUCTION BLOCK

(71) Applicant: Johnson Concrete Company, Salisbury, NC (US)

(72) Inventors: Charles Benjamin Newsome, Salisbury, NC (US); Jody Ryan Wall, Kannapolis, NC (US); William Clyde Meade, Moravian Falls, NC (US)

(73) Assignee: Johnson Concrete Company, Salisbury, NC (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/680,870

(22) Filed: Aug. 18, 2017

Related U.S. Application Data

(63) Continuation of application No. 14/755,453, filed on Jun. 30, 2015, now Pat. No. 9,739,058, which is a continuation of application No. 13/924,722, filed on Jun. 24, 2013, now Pat. No. 9,068,348.

(51) Int. Cl.
*E04C 1/39* (2006.01)
*E04B 1/04* (2006.01)

(52) U.S. Cl.
CPC ..... *E04C 1/39* (2013.01); *E04B 1/04* (2013.01); *E04B 2103/02* (2013.01)

(58) Field of Classification Search
None
See application file for complete search history.

(56) References Cited

U.S. PATENT DOCUMENTS 2,684,589 A * 7/1954 Perreton ..... E04B 2/42 52/223.7
3,546,833 A 12/1970 Perreton
3,902,296 A * 9/1975 Thomas ..... E04B 2/44 52/426
4,123,881 A 11/1978 Muse
4,527,373 A * 7/1985 Cruise ..... B28B 11/042 52/405.1
4,597,236 A 7/1986 Braxton
4,640,071 A 2/1987 Haener
4,671,039 A 6/1987 Hunt
5,024,035 A 6/1991 Hanson et al.
5,072,556 A * 12/1991 Egenhoefer ..... E04L 32/54 52/126.4
5,567,089 A 10/1996 Akamine
(Continued)

OTHER PUBLICATIONS

"Design Avoiding Thermal Bridges—Preferable Not Only for Passive Houses";Thermal Bridges—how to avoid them; http://www.passivhaustagung.de; 2pgs; published prior May 31, 2013.

*Primary Examiner* — Paola Agudelo
(74) *Attorney, Agent, or Firm* — Schwartz Law Firm, P.C.

(57) ABSTRACT

A modular construction block comprises a masonry block shell including first and second opposing side walls, and an intermediate cross-web formed between the side walls. Each of the first and second side walls comprises first and second opposing end edges, a relatively thin wall section extending from the cross-web to the first end edge, and a relatively thick wall section extending from the cross-web to the second end edge. The relatively thick wall section of each side wall tapers from the cross-web toward the second end edge of the side wall.

6 Claims, 11 Drawing Sheets

(56) References Cited

U.S. PATENT DOCUMENTS

| | | | | |
|---|---|---|---|---|
| 5,575,128 | A | 11/1996 | Haener | |
| 5,894,702 | A * | 4/1999 | Stenekes | E04B 2/46 52/592.1 |
| 6,226,951 | B1 * | 5/2001 | Azar | E04B 2/16 52/421 |
| 6,591,569 | B2 | 7/2003 | Azar | |
| 7,073,304 | B2 * | 7/2006 | Hampton | E02D 29/025 405/284 |
| 7,665,269 | B2 | 2/2010 | Azar | |
| 2002/0038532 | A1 * | 4/2002 | Huberty | B28B 7/24 52/596 |
| 2005/0055944 | A1 * | 3/2005 | Hampton | E02D 29/025 52/596 |
| 2005/0279046 | A1 | 12/2005 | Gravier et al. | |
| 2007/0094989 | A1 * | 5/2007 | Scheker | E04B 2/16 52/596 |
| 2008/0168725 | A1 | 7/2008 | Malone | |
| 2010/0101170 | A1 | 4/2010 | Mancine | |
| 2010/0303555 | A1 | 12/2010 | Herse et al. | |

* cited by examiner

MODULAR CONSTRUCTION BLOCK

TECHNICAL FIELD AND BACKGROUND OF THE INVENTION

This invention relates broadly and generally to a modular construction block, vertical wall or other structure constructed of an assembly of such blocks, and method for constructing a vertical wall or other structure. Such structures are commonly formed of hollow masonry units with cores filled with loose material and/or grout. This construction method generally provides reduced wall thickness, while allowing insulation and reinforcement to be included in the cores to increase thermal and structural performance. In an exemplary embodiment, the present disclosure comprises a molded and integrally formed masonry construction block. The block may be made from Portland cement, coarse and fine aggregates, water and various admixtures. In alternative embodiments, the exemplary construction block may be formed in parts, and may be constructed of other suitable natural or synthetic materials.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a modular construction block. The construction block comprises a masonry block shell including first and second opposing side walls, and an intermediate cross-web formed between the side walls. Each of the first and second side walls comprises first and second opposing end edges, a relatively thin wall section extending from the cross-web to the first end edge, and a relatively thick wall section extending from the cross-web to the second end edge. The relatively thick wall section of each side wall tapers from the cross-web toward the second end edge of the side wall.

The exemplary construction block may be integrally formed as a single homogenous unit, or assembled together in two or more parts fabricated of masonry and/or non-masonry materials.

According to another exemplary embodiment, the masonry block shell further comprises an end wall integrally formed with the first and second side walls at respective first end edges.

According to another exemplary embodiment, the first and second side walls, end wall, and cross-web cooperate to define a hollow core of the construction block.

According to another exemplary embodiment, the cross-web has first and second exposed ends, a thickness, and a height. The height extends from the first exposed end to the second exposed end. The thickness of the cross-web at the first exposed end is less than a thickness of the relatively thin wall section of each side wall.

According to another exemplary embodiment, the thickness of the cross-web at its second exposed end is greater than the thickness at its first exposed end.

According to another exemplary embodiment, the thickness of the cross-web is substantially uniform along more than 80% of its height from the first exposed end towards the second exposed end.

According to another exemplary embodiment, the thickness of the cross-web at the second exposed end is increased along less than 20% of its height, such that the increased thickness defines a hand hold for lifting and placing the construction block.

According to another exemplary embodiment, the thickness of the cross-web is substantially uniform from the first side wall of the block shell to the second side wall of the block shell.

According to another exemplary embodiment, the cross-web extends from a top of the block shell to a bottom of the block shell.

In another exemplary embodiment, the present disclosure comprises a module construction block comprising a masonry block shell having first and second opposing side walls, and a knock-out end wall formed between the side walls. The knock-out end wall defines at least one score line. The score line forms a point of relative structural weakness, such that the knock-out end wall is adapted for being broken away from the construction block after its manufacture and prior to installation.

According to another exemplary embodiment, the knock-out end wall has a thickness, and the score line has a depth greater than 40% of the thickness of the end wall.

According to another exemplary embodiment, the knock-out end wall defines a plurality of spaced apart parallel score lines.

According to another exemplary embodiment, each score line extends substantially continuously from a top edge of the end wall to a bottom edge of the end wall.

According to another exemplary embodiment, two of the score lines are formed adjacent respective end edges of the first and second side walls.

According to another exemplary embodiment, a third score line is formed substantially at a center point of the knock-out end wall.

According to another exemplary embodiment, the masonry block shell further comprises an intermediate cross-web spaced apart from the knock-out end wall and formed between the opposing side walls.

In yet another exemplary embodiment, the present disclosure comprises a vertical wall formed by an assembly of modular construction blocks. Each construction block comprises a masonry block shell including first and second opposing side walls, and an intermediate cross-web formed between the side walls. Each of the first and second side walls comprises first and second opposing end edges, a relatively thin wall section extending from the cross-web to the first end edge, and a relatively thick wall section extending from the cross-web to the second end edge. The relatively thick wall section of each side wall tapers from the cross-web toward the second end edge of the side wall.

In still another exemplary embodiment, the present disclosure comprises a vertical wall formed by an assembly of modular construction blocks. Each construction block comprises a masonry block shell having first and second opposing side walls, and a knock-out end wall formed between the side walls. The knock-out end wall defines at least one score line. The score line forms a point of relative structural weakness, such that the knock-out end wall is adapted for being broken away from the construction block after its manufacture and prior to installation.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 4:
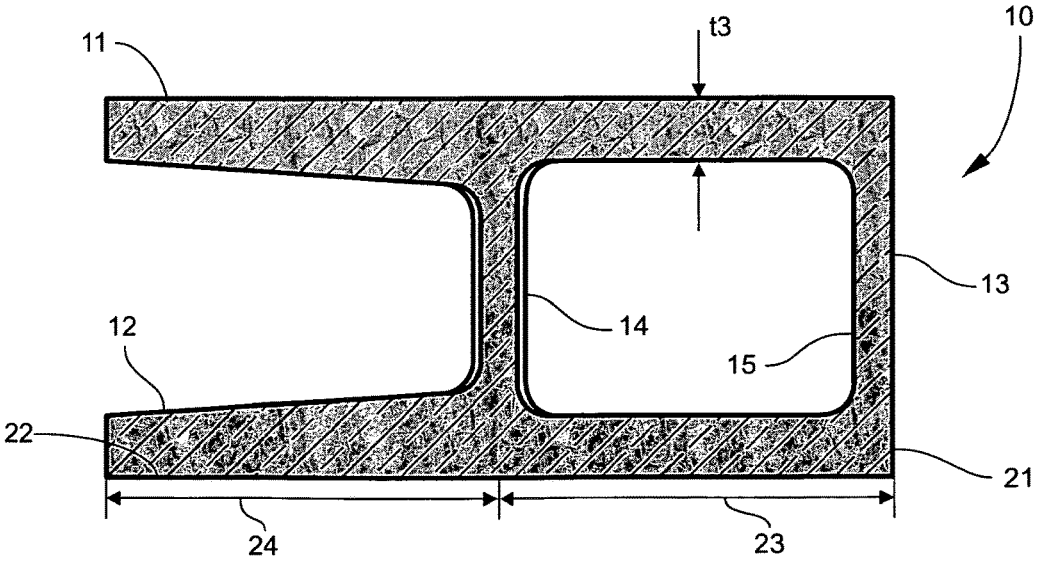
FIG. 4 is a plan view of the exemplary block.

Referring now specifically to the drawings, exemplary embodiments of the present disclosure comprise a modular construction block adapted for assembly with a number of other blocks in a vertical wall or other structure. Exemplary construction block 10 is illustrated in FIGS. 1-8. The construction block (or "A-block") 10 comprises a masonry block shell having identical opposing (mirrored) side walls 11, 12, an end wall 13, and an intermediate cross-web 14. The end wall 13 and cross-web 14 are integrally formed with the opposing side walls 11, 12, and cooperate with the side walls 11, 12 to define a hollow core 15. The block core 15 is designed for receiving grout, foam insulation, vertical rebar and/or other reinforcement (not shown). In the exemplary embodiment, each of the side walls 11, 12 has first and second opposing end edges 21, 22, a relatively thin wall section 23 extending from the cross-web 14 to the first end edge 21, and a relatively thick wall 24 section extending from the cross-web 14 to the second end edge 22. As best shown in FIG. 4, the relatively thick wall section 24 of each side wall 11, 12 tapers (narrows) from the cross-web 14 toward the second end edge 22. The side walls 11, 12 define respective planar side faces 11A, 12A, or "face shells". The end wall 13 is formed with respective end edges 21 of side walls 11, 12 and defines a planar end face 13A, or "end shell".

Figure 1:
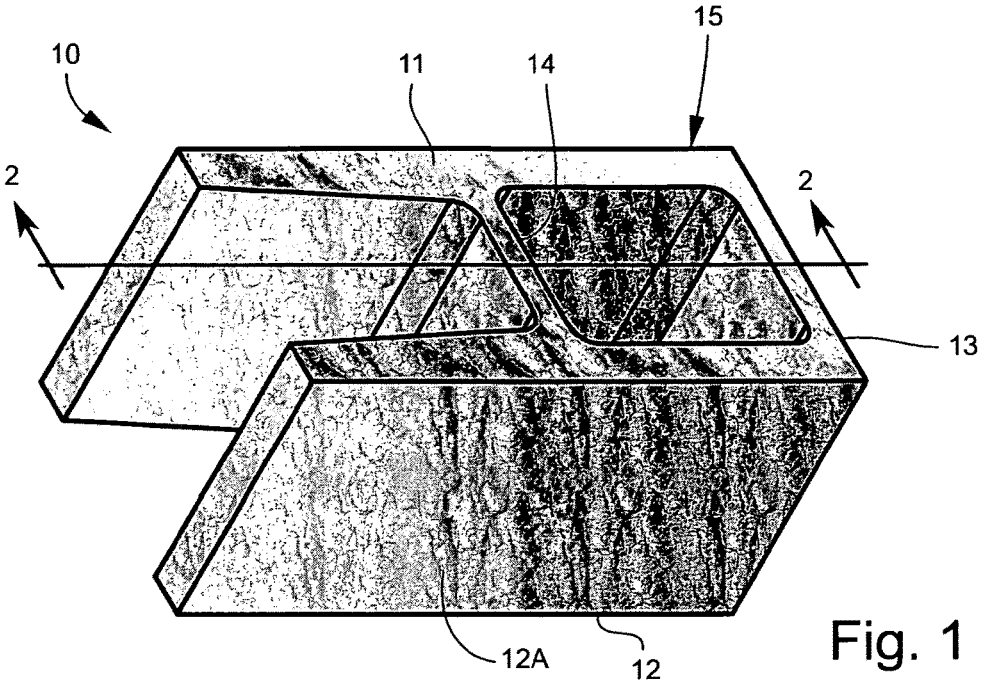
FIG. 1 is a perspective view of a modular masonry construction block according to one exemplary embodiment of the present disclosure.
Figure 2:
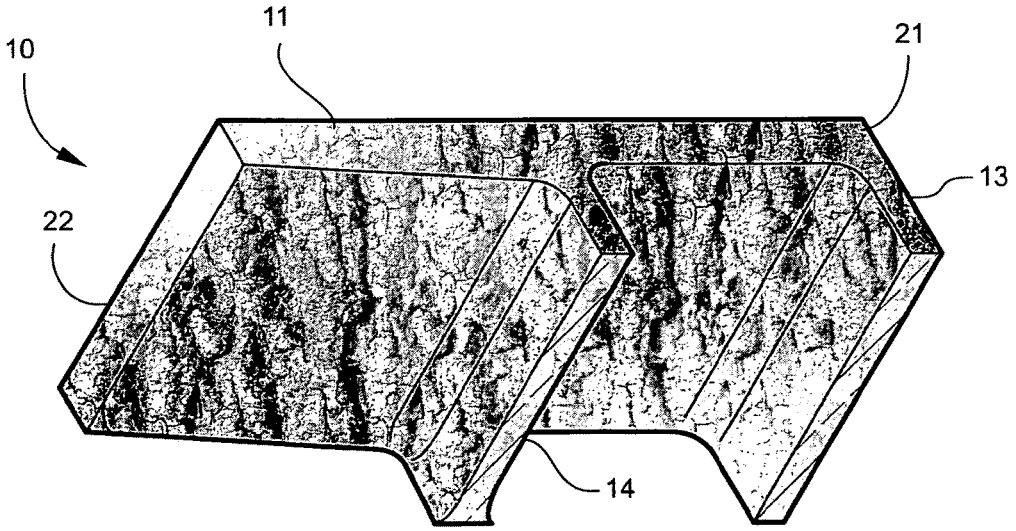
FIG. 2 is a cross-sectional view of the exemplary block taken substantially along line 2-2 of FIG. 1.
Figure 3:
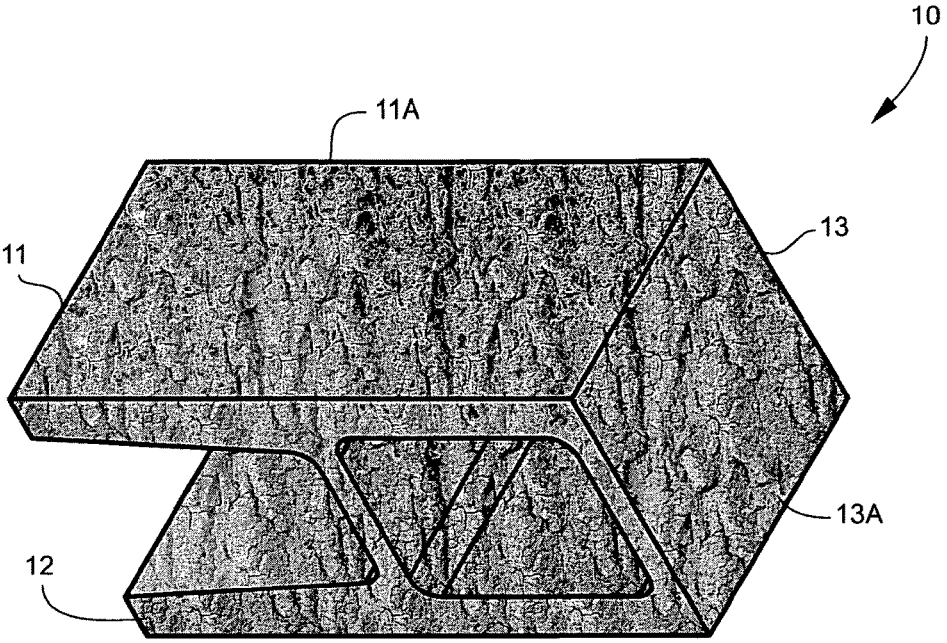
FIG. 3 is a further perspective view of the exemplary block
Figure 5:
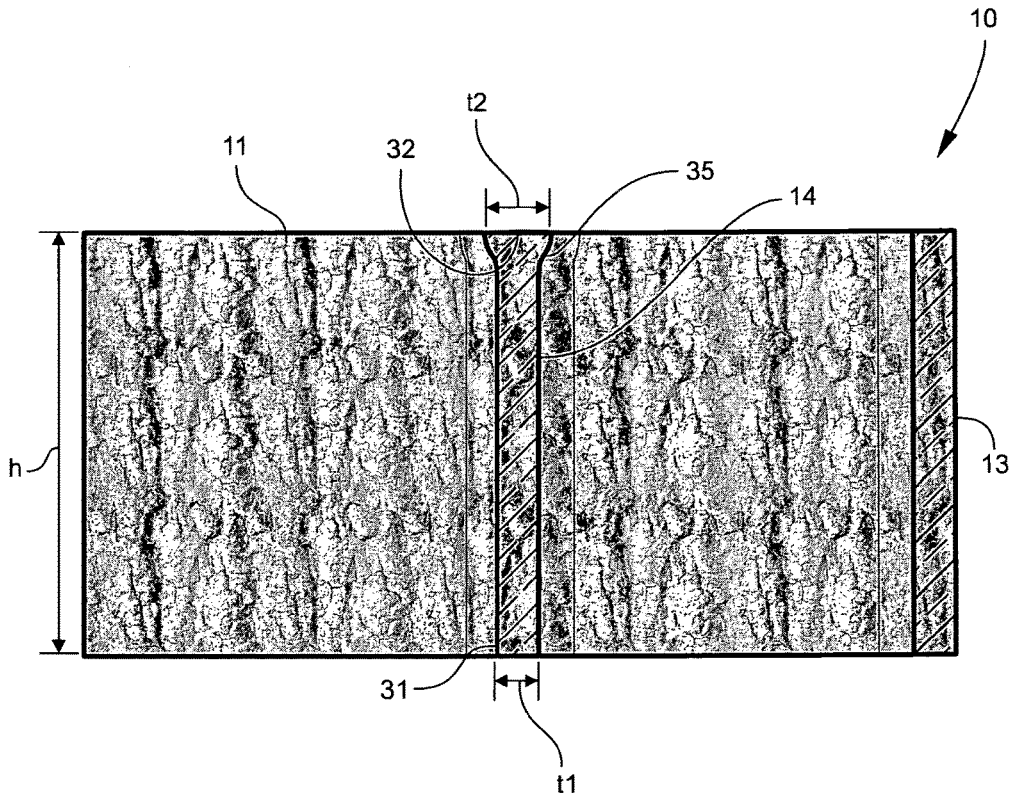
FIG. 5 is a further cross-sectional view of the exemplary block.

Referring to FIGS. 2, 4, and 5, the intermediate cross-web 14 of construction block 10 has first and second exposed ends 31, 32, a thickness "t1" and "t2", and a height "h". The height "h" extends from the first exposed end 31 to the second exposed end 32. The thickness "t1" of the cross-web at the first exposed end 31 is less than a thickness "t3" of the relatively thin wall section 23 of each side wall 11, 12, and is substantially uniform along more than 80% of the cross-web height "h" from the first exposed end 31 towards the second exposed end 32. The thickness "t2" of the cross-web 14 at its second exposed end 32 is greater than the thickness "t1" at its first exposed end 31, and is thicker along less than 20% of the cross-web height "h" such that the increased thickness defines a hand hold 35 for lifting and placing the construction block 10. As best shown in FIGS. 4 and 5, the cross-web 14 extends from a top of the block 10 to a bottom of the block 10, and has a relatively uniform cross-sectional thickness from the first side wall 11 to the second side wall 12.

Figure 6:
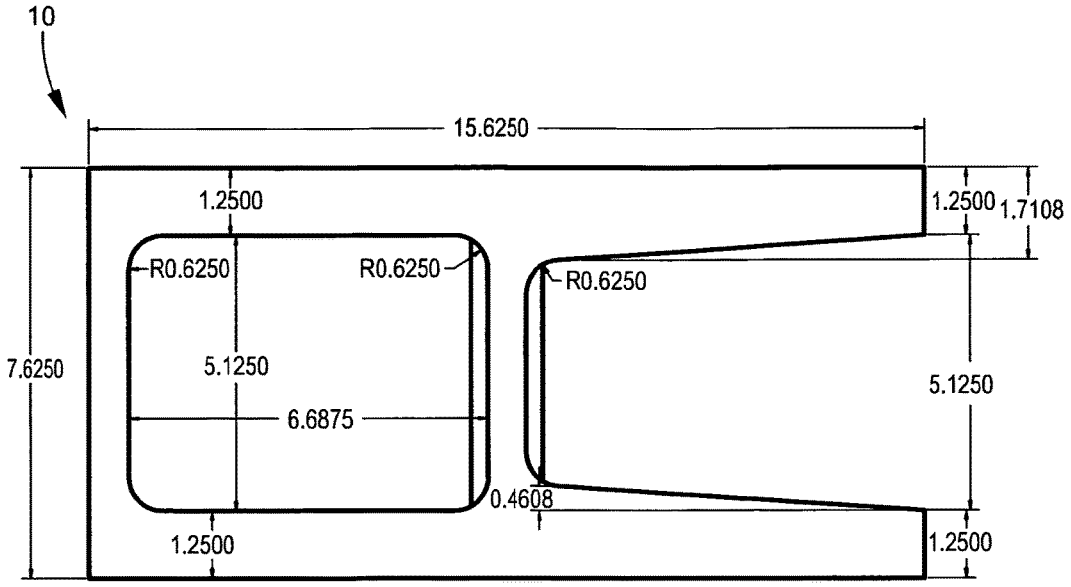
FIGS. 6 and 7 are views of the present block with exemplary dimensions labeled.
Figure 7:
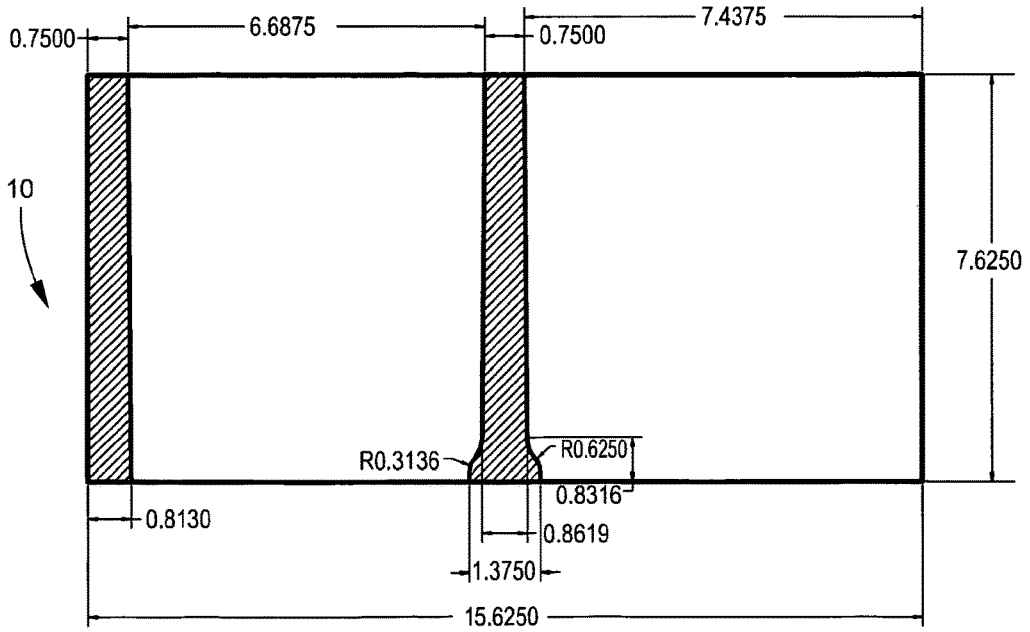
Figure 8:
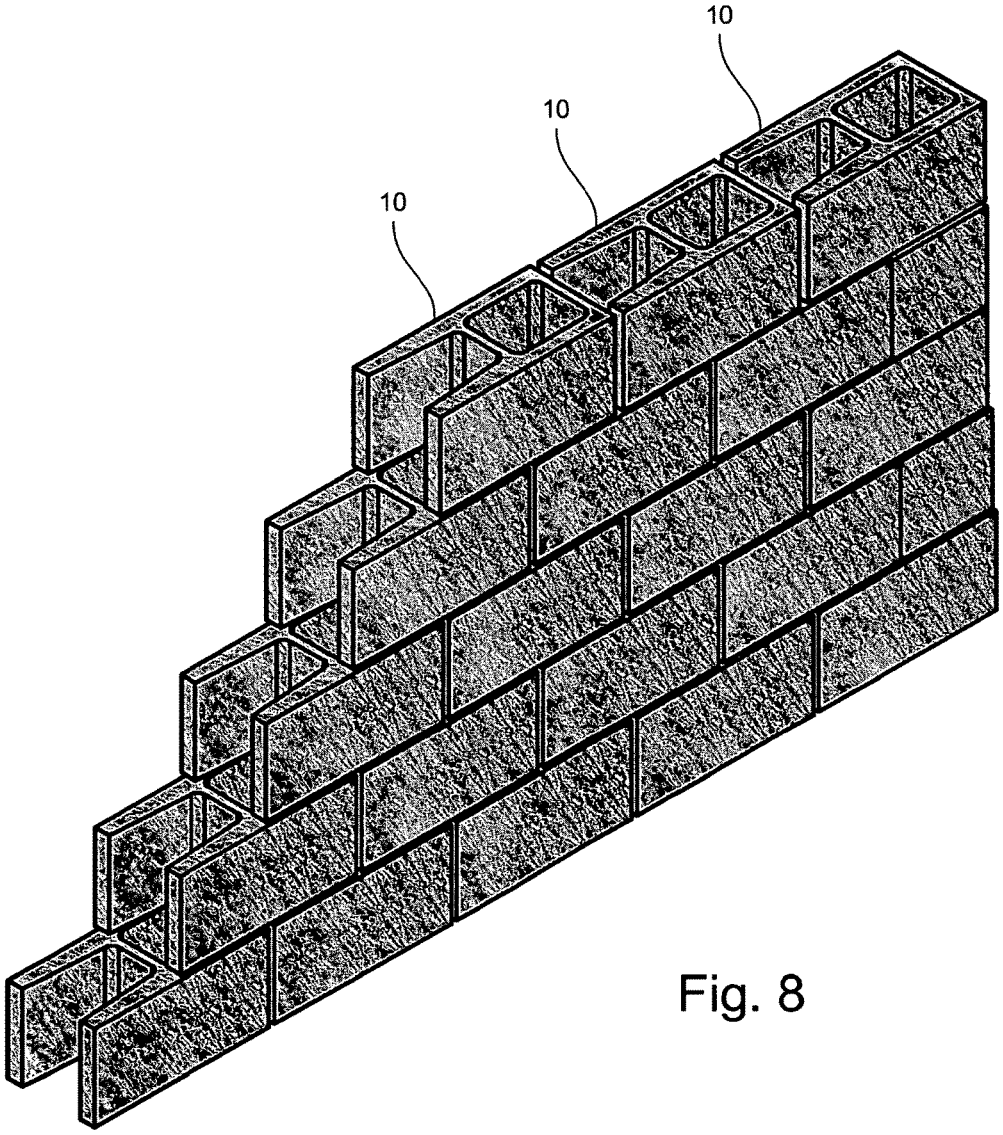
FIG. 8 is a view showing a partially constructed vertical wall comprising an assembly of exemplary blocks.
Figure 9:
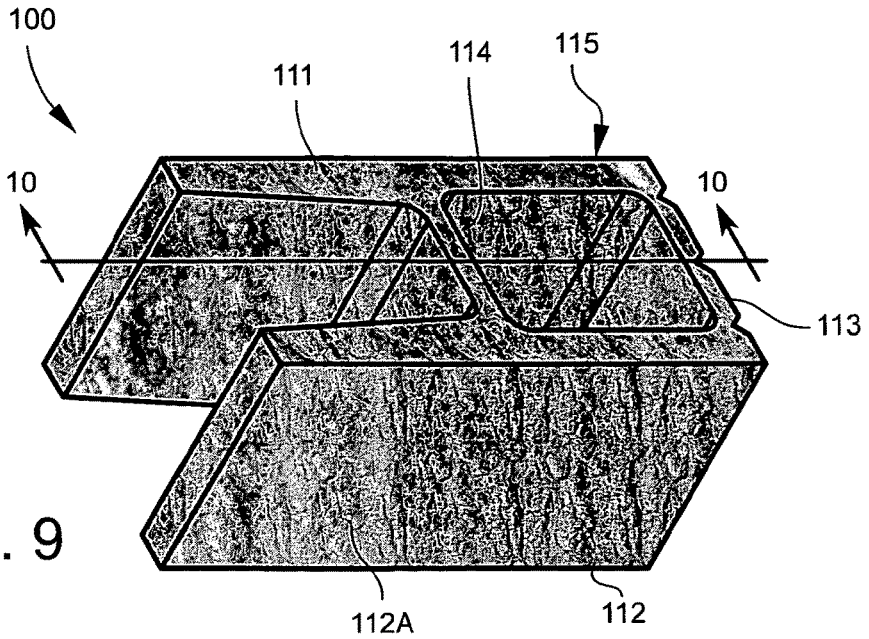
FIG. 9 is a perspective view of a modular masonry construction block according to an alternative exemplary embodiment of the present disclosure.
Figure 10:
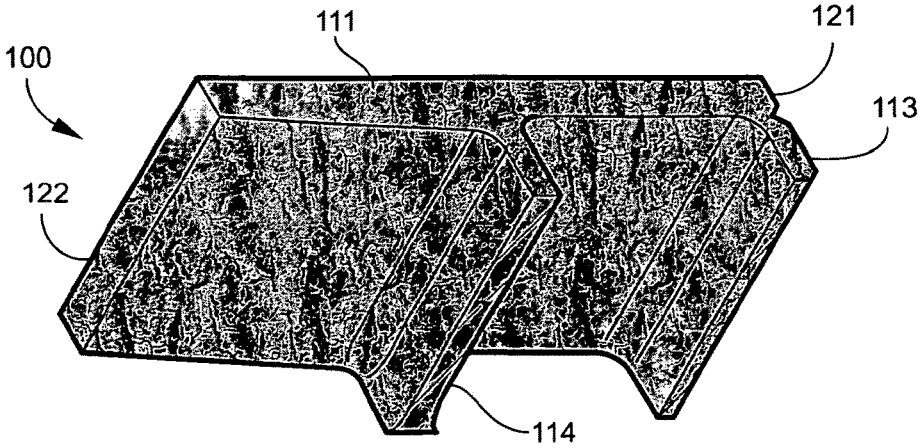
FIG. 10 is a cross-sectional view of the exemplary block taken substantially along line 10-10 of FIG. 9.

FIGS. 6 and 7 disclose one exemplary embodiment of the present wall block 10 with dimensions provided in inches. The numerical dimensions serve to establish the relative size, shape, and thickness of various structural parts and features, and are included only for purposes of exemplary illustration. A partial vertical wall "W" constructed using an assembly of the present modular blocks 10 is illustrated in FIG. 8.

Figure 11:
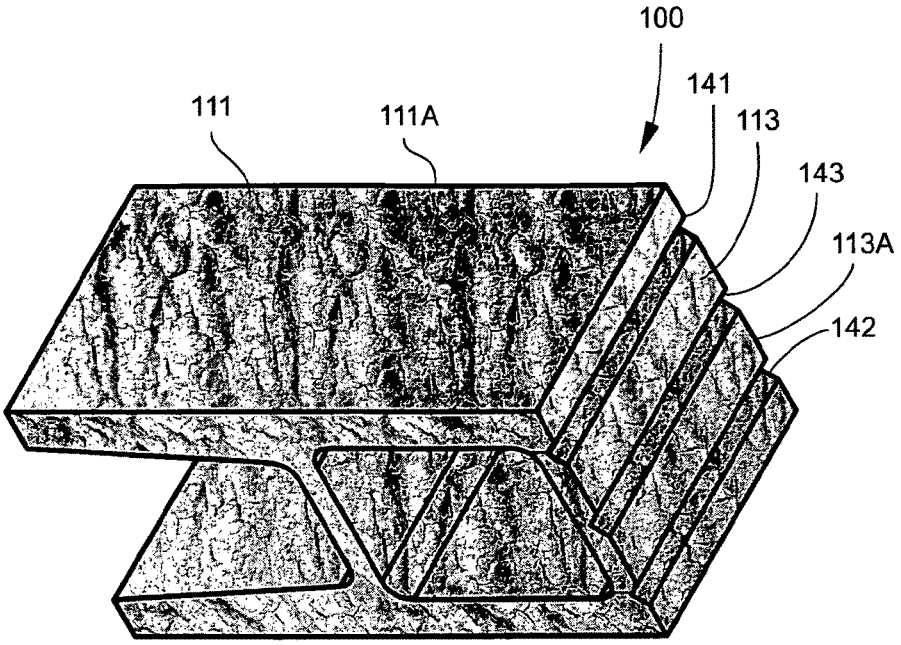
FIG. 11 is a further perspective view of the exemplary block

A further exemplary embodiment of the present disclosure is illustrated in FIGS. 9-15. Construction block 100 comprises a masonry block shell having identical opposing (mirrored) side walls 111, 112, a knock-out end wall 113, and an intermediate cross-web 114. The end wall 113 and cross-web 114 are integrally formed with the opposing side walls 111, 112, and cooperate with the side walls to define a hollow core 115. Like block 10, each of the side walls 111, 112 has first and second opposing end edges 121, 122, a relatively thin wall section 123 extending from the cross-web 114 to the first end edge 121, and a relatively thick wall section 124 extending from the cross-web 114 to the second end edge 122. As best shown in FIG. 11, the relatively thick wall section 124 of each side wall 111, 112 tapers (narrows) from the cross-web 114 toward the second end edge 122. The side walls 111, 112 define respective planar side faces 111A, 112A (or "face shells"), while the end wall 113 defines a vertically scored end face 113A (or "end shell").

Figure 13:
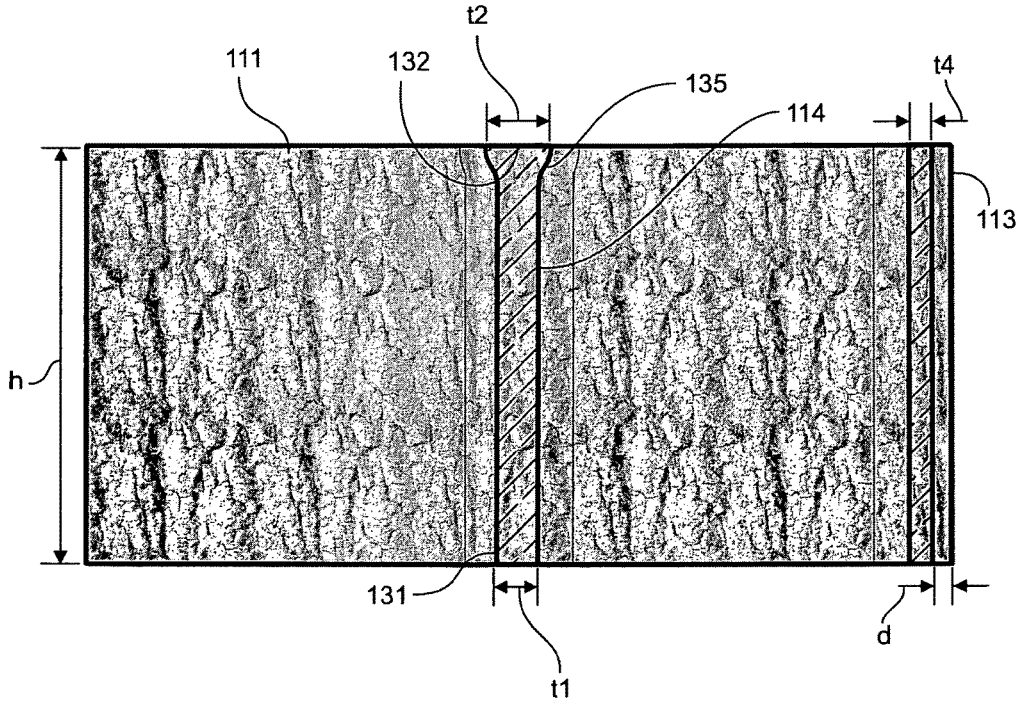
FIG. 13 is a further cross-sectional view of the exemplary block.

Like block 10, the intermediate cross-web 114 of construction block 100 has first and second exposed ends 131, 132, a thickness "t1" and "t2", and a height "h". The height "h" extends from the first exposed end 131 to the second exposed end 132. The thickness "t1" of the cross-web 114 at the first exposed end 131 is less than a thickness "t3" of the relatively thin wall section 123 of each side wall 111, 112, and is substantially uniform along more than 80% of the cross-web height "h" from the first exposed end 131 towards the second exposed end 132. The thickness "t2" of the cross-web 114 at its second exposed end 132 is greater than the thickness "t1" at its first exposed end 131, and is thicker along less than 20% of the cross-web height "h" such that the increased thickness defines a hand hold 135 for lifting and placing the construction block 100. As best shown in FIGS. 11 and 13, the cross-web 114 extends from a top of the block 100 to a bottom of the block 100, and has a relatively uniform cross-sectional thickness from the first side wall 111 to the second side wall 112.

Figure 12:
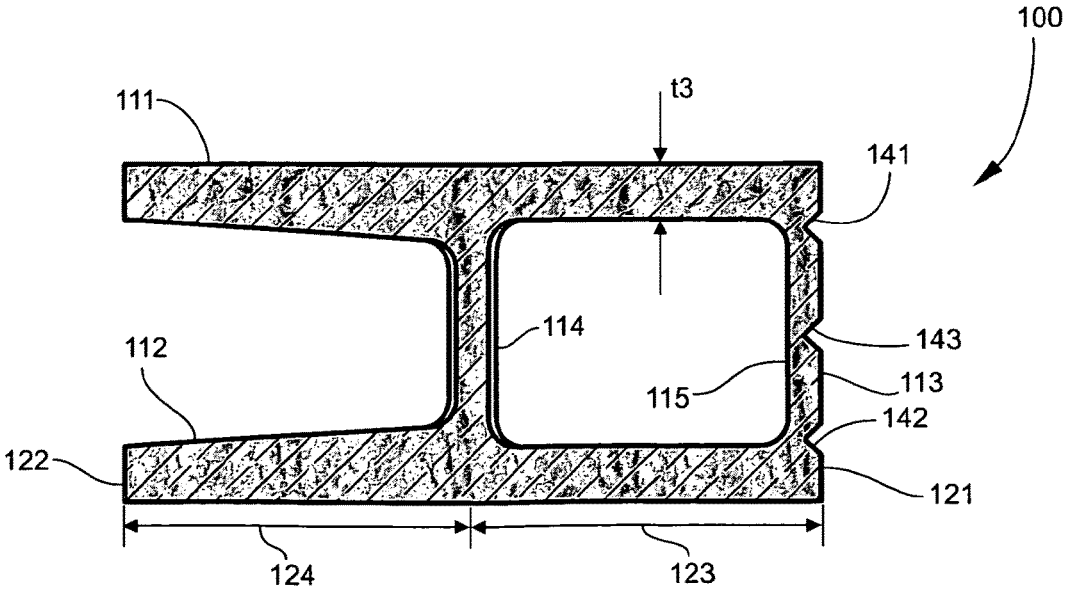
FIG. 12 is a plan view of the exemplary block.

Referring to FIGS. 11, 12, and 13, the knock-out end wall 113 of the exemplary block 100 includes an number of spaced-apart parallel score lines 141, 142, and 143 extending vertically and substantially continuously from a top edge of the end wall 113 to a bottom edge of the end wall 113. Two of the score lines 141, 142 are formed adjacent respective end edges 121 of the first and second side walls 111, 112, while the third score line 143 is formed substantially at a center point of the end wall 113. In one embodiment, the exemplary score lines 141-143 are substantially V-shaped, and have a substantially uniform depth "d" from the top edge of the end wall 113 to the bottom edge of the end wall 113. The score depth "d" may be greater (or deeper) than 40% of the thickness "t4" of the end wall 113. The score lines 141-143 form respective points of relative structural weakness, such that the knock-out end wall 113 may optionally be broken away from the construction block 100 after its manufacture and prior to installation.

Figure 14:
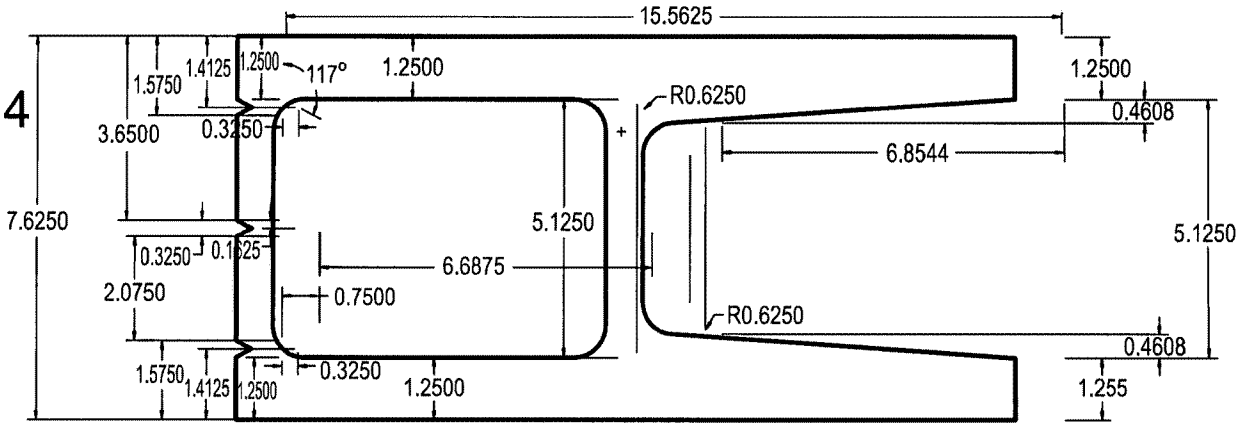
FIGS. 14 and 15 are views of the alternative construction block with exemplary dimensions labeled.
Figure 15:
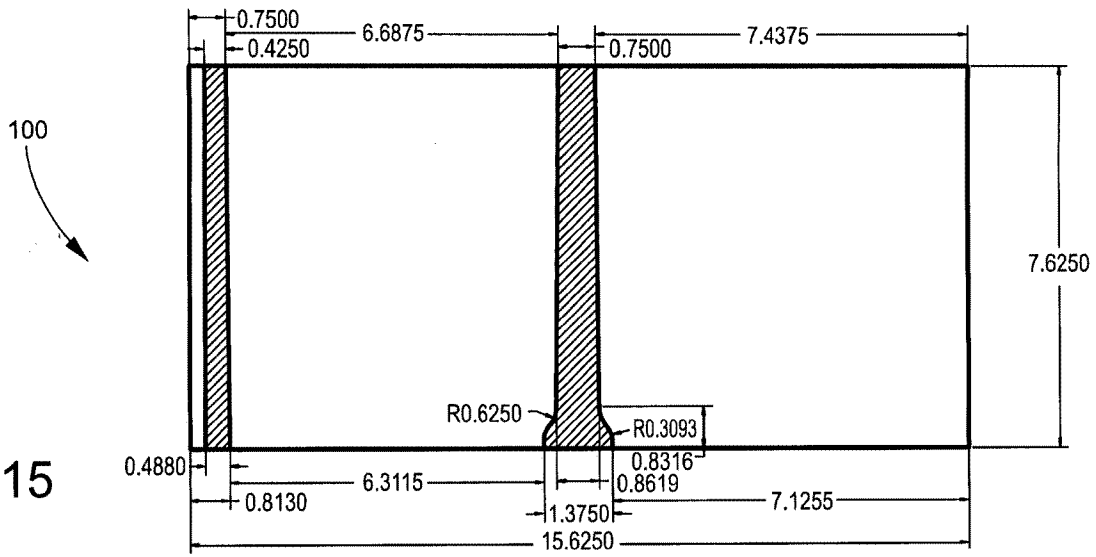

FIGS. 14 and 15 disclose one exemplary embodiment of the wall block 100 with dimensions provided in inches. The numerical dimensions serve to establish the relative size, shape, and thickness of various structural parts and features, and are included only for purposes of exemplary illustration.

Figure 16:
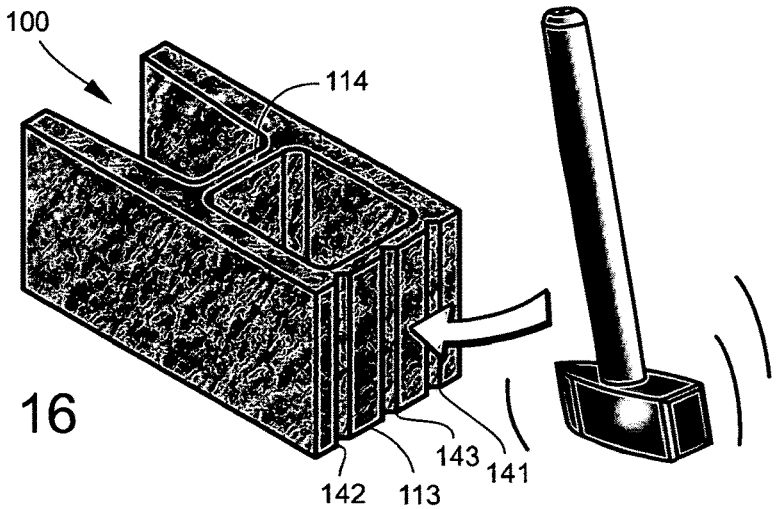
FIGS. 16, 17, and 18 are sequential views demonstrating one process for separating the knock-out end wall from the exemplary construction block.
Figure 17:
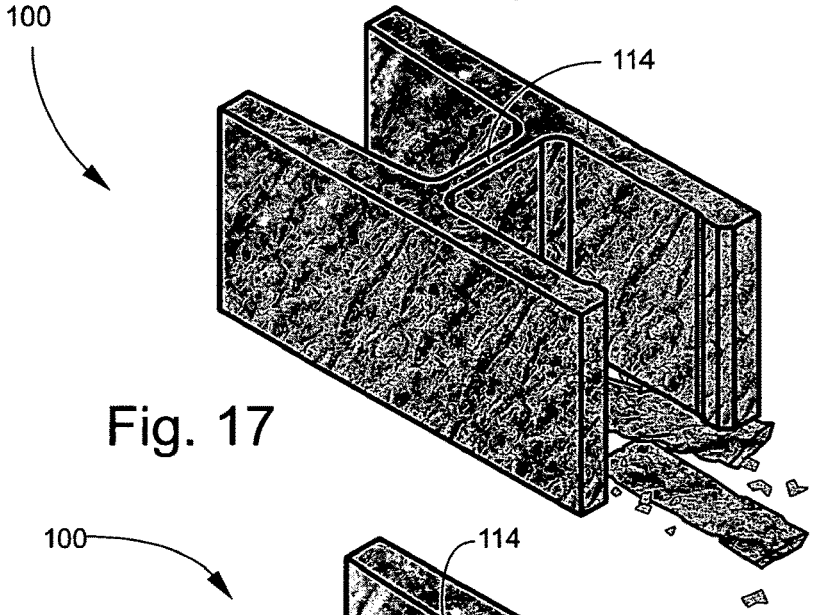
Figure 18:
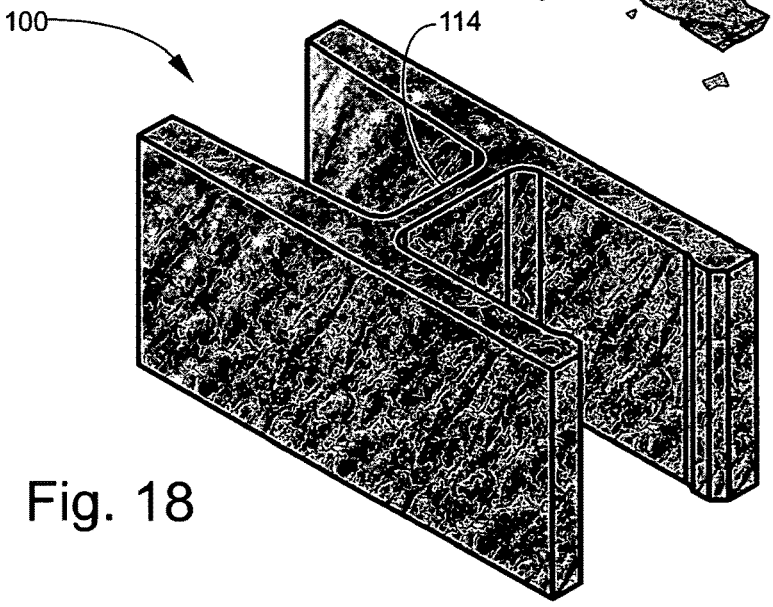
Figure 19:
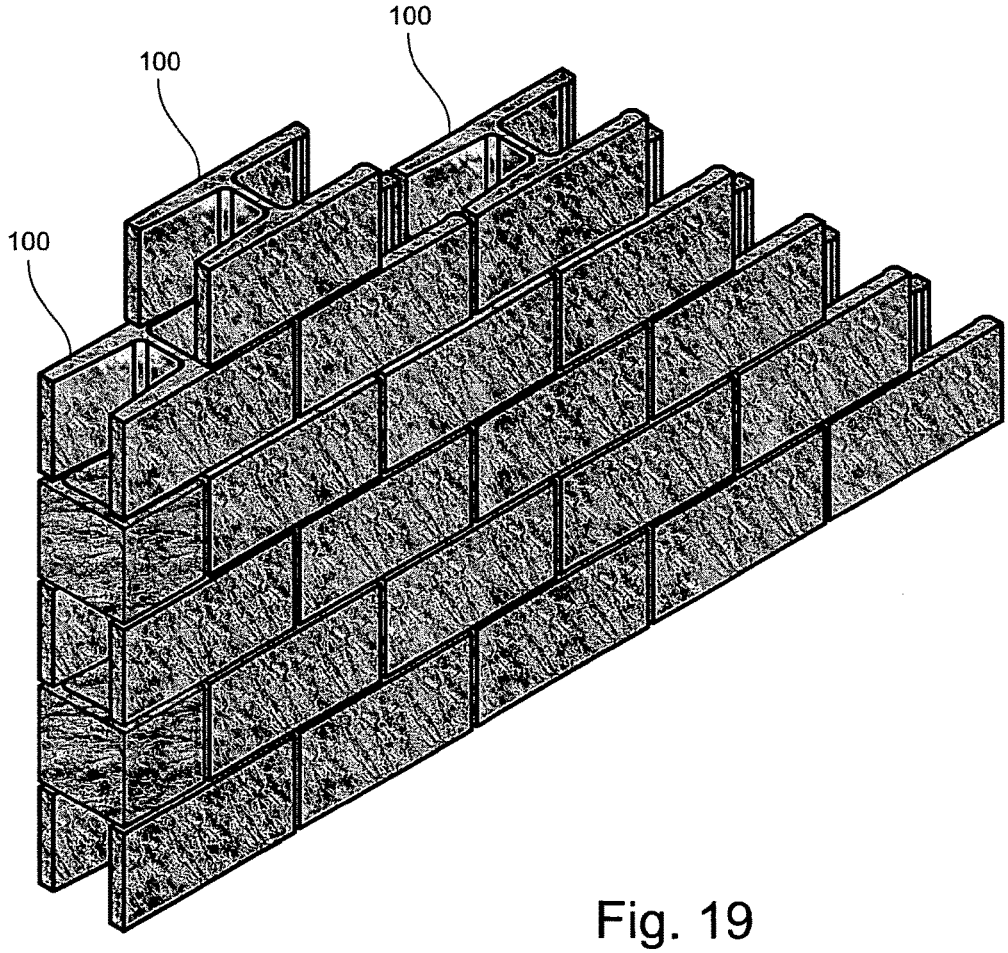
FIG. 19 is a view showing a partially constructed vertical wall comprising an assembly of present blocks.

The construction block 100 may be assembled in a vertical wall or other structure (as an "A-block") in a manner similar to block 10. Alternatively, as demonstrated in FIGS. 14-16, the knock-out end wall 113 may be broken away from the construction block 100 using a hand tool 150 or other device impacting the block 100 along or adjacent one or more score lines 141-143. The multiple score lines 141-143 facilitate clean and controlled separation of the end wall 113, thereby transforming the exemplary "A-block" to an "H-block" having only a single narrow cross-web 114. The narrow cross-web 114 may offer reduced heat loss through the block 100 via thermal bridging, and may limit other negative effects caused by thermal bridges. A partial vertical wall "W" constructed using an assembly of the present blocks 100 with respective knock-out end walls 113 broken away is illustrated in FIG. 19.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed:

1. A modular construction block, comprising:

a masonry block shell having a top and a bottom, and comprising first and second opposing side walls, and an intermediate cross-web extending continuously between said side walls and continuously from the top of said block shell to the bottom of said block shell, and wherein said cross-web has first and second exposed ends, a thickness, and a height, the height extending from the first exposed end to the second exposed end, and wherein the thickness of said cross-web is greater at the second exposed end along less than 20% of its height, such that the increased thickness at the second exposed end defines a hand hold for lifting and placing said construction block;

each of said first and second side walls comprising first and second opposing planar end edges, a thin wall section extending from said cross-web to the first end edge, and a thick wall section extending from said cross-web to the second end edge, said thin wall section being thinner than said thick wall section along at least one of the top and bottom of said block shell, and along substantially an entire length of said thick wall section preceding the second end edge; and the thick wall section of each side wall tapering from said cross-web toward the second end edge of said side wall.

2. The modular construction block according to claim 1, wherein said masonry block shell further comprises an end wall integrally formed with said first and second side walls adjacent respective first end edges.

3. The modular construction block according to claim 2, wherein said first and second side walls, said end wall, and cross-web cooperate to define a hollow core therebetween.

4. A vertical wall formed by an assembly of modular construction blocks, each construction block comprising:

a masonry block shell having a top and a bottom, and comprising first and second opposing side walls, and an intermediate cross-web extending continuously between said side walls and continuously from the top of said block shell to the bottom of said block shell, and wherein said cross-web has first and second exposed ends, a thickness, and a height, the height extending from the first exposed end to the second exposed end, and wherein the thickness of said cross-web is greater at the second exposed end along less than 20% of its height, such that the increased thickness at the second exposed end defines a hand hold for lifting and placing said construction block;

each of said first and second side walls comprising first and second opposing planar end edges, a thin wall section extending from said cross-web to the first end edge, and a thick wall section extending from said cross-web to the second end edge, said thin wall section being thinner than said thick wall section along at least one of the top and bottom of said block shell, and along substantially an entire length of said thick wall section preceding the second end edge; and the thick wall section of each side wall tapering from said cross-web toward the second end edge of said side wall.

5. The vertical wall according to claim 4, wherein said masonry block shell further comprises an end wall integrally formed with said first and second side walls adjacent respective first end edges.

6. The vertical wall according to claim 5, wherein said first and second side walls, said end wall, and cross-web cooperate to define a hollow core therebetween.

* * * * *